US008354036B2

(12) United States Patent
Catalan-Asenjo et al.

(10) Patent No.: US 8,354,036 B2
(45) Date of Patent: Jan. 15, 2013

(54) METHOD FOR THE PRE-TREATMENT OF TITANIUM COMPONENTS FOR THE SUBSEQUENT COATING THEREOF

(75) Inventors: Helena Catalan-Asenjo, Munich (DE); Michael Scheid, Den Haag (NL); Josef Linska, Grafing (DE); Matthias Schmidt, Brehna (DE)

(73) Assignee: MTU Aero Engines GmbH, Munich (DE)

( * ) Notice: Subject to any disclaimer, the term of this patent is extended or adjusted under 35 U.S.C. 154(b) by 954 days.

(21) Appl. No.: 12/085,336

(22) PCT Filed: Nov. 14, 2006

(86) PCT No.: PCT/DE2006/001992

§ 371 (c)(1),
(2), (4) Date: Apr. 6, 2009

(87) PCT Pub. No.: WO2007/059730

PCT Pub. Date: May 31, 2007

(65) Prior Publication Data

US 2009/0218232 A1 Sep. 3, 2009

(30) Foreign Application Priority Data

Nov. 21, 2005 (DE) ..... 10 2005 055 303

(51) Int. Cl.
*B44C 1/22* (2006.01)

(52) U.S. Cl. ..... 216/100; 216/108; 216/109; 205/212; 205/271; 427/309; 427/444

(58) Field of Classification Search ..... None
See application file for complete search history.

(56) References Cited

U.S. PATENT DOCUMENTS

| | | | | |
|---|---|---|---|---|
| 2,864,732 | A | 12/1958 | Miller et al. | 148/6.15 |
| 3,207,679 | A | 9/1965 | Schmidt | 204/42 |
| 3,562,013 | A | 2/1971 | Mickelson et al. | 134/3 |
| 3,725,217 | A * | 4/1973 | Hartshorn, Jr. | 428/472.1 |
| 4,314,876 | A | 2/1982 | Kremer et al. | 156/664 |
| 4,414,039 | A | 11/1983 | Thoma | 148/62 |
| 4,655,884 | A | 4/1987 | Hills et al. | 204/321 |
| 4,938,850 | A | 7/1990 | Rothschild et al. | 204/29 |
| 6,056,815 | A * | 5/2000 | Fu | 106/417 |

FOREIGN PATENT DOCUMENTS

| | | |
|---|---|---|
| DE | 2 035 659 | 2/1971 |
| DE | 3710950 A * | 10/1988 |
| EP | 0 072 986 | 3/1983 |
| EP | 0 494 579 | 7/1992 |
| WO | WO 90/03457 | 4/1990 |

* cited by examiner

*Primary Examiner* — Anita Alanko
(74) *Attorney, Agent, or Firm* — Davidson, Davidson & Kappel, LLC

(57) ABSTRACT

A method for the pre-treatment of titanium components for the subsequent coating thereof is provided. The method includes at least the following steps: a) etching of the component in an acidic solution containing fluoride and nitric acid (HNO3); b) activation pickling of the etched component in a solution containing at least sodium nitrate (NaNO3) and tetrafluoroboric acid (HBF4); and c) activation of the activation-pickled component in a bath containing acid or in an acidic bath containing nickel.

9 Claims, No Drawings

METHOD FOR THE PRE-TREATMENT OF TITANIUM COMPONENTS FOR THE SUBSEQUENT COATING THEREOF

This application is a national phase of International Application No. PCT/DE2006/001992, filed Nov. 14, 2006, which claims priority to German Application No. DE 10 2005 055 303.6, filed Nov. 21, 2005.

FIELD OF THE INVENTION

The invention relates to a method for the pre-treatment of titanium components for the subsequent coating thereof.

BACKGROUND

Components made of titanium materials, especially titanium-based alloys, are of great significance in technical circles. Titanium materials display great strength while having a low density as well as good corrosion resistance and heat resistance. Particularly in the aviation and aerospace industries as well as in aircraft engine construction, components made of titanium materials are of great importance. However, at an elevated temperature in the presence of gases, titanium materials tend towards oxidation or sulfidation. Moreover, the resistance to wear and tear of titanium materials is limited due to friction, erosion and fretting. Besides, titanium materials have a tendency towards stress corrosion cracking.

In order to improve the behavior of components made of titanium materials, it is a known procedure according to the state of the art to apply a metallic coating onto the surface areas of components made of titanium materials. Such coating means that the area of application of components made of titanium materials can be expanded. In this context, components made of titanium materials are normally chemically or electrochemically coated or electroplated with nickel. It is likewise known from the state of the art to coat components made of titanium materials with platinum, chromium, zinc or copper.

When components made of titanium materials are electroplated, the problem is encountered that titanium materials passivate, which prevents proper adhesion of the metallic coating to a component made of a titanium material. As a result, upon exposure to air or water, a thin oxide film is quickly formed on components made of titanium materials, thus preventing proper adhesion of the metallic coating to the titanium component. Consequently, in order to electroplate a component made of titanium material, there is a need for a special pre-treatment of the titanium component for purposes of activating the surface of the component to be coated so as to remove the oxide layer or the passive layer and to prevent the renewed formation of the oxide layer.

For instance, European patent specification EP 0 072 986 B1 discloses a method for activating the surfaces of titanium components, in which method the surface of a titanium component is first wet-blasted with fine-grain aluminum-oxide particles, and the activation of the surface with a solution of chromic acid, hydrofluoric acid and hexafluorosilicic acid is carried out after the wet blasting. Chromic acid, however, contains hexavalent chromium ($Cr^{6+}$), which poses a clear hazard to safety, the environment and health. Moreover, the abrasive wet blasting procedure cannot be carried out uniformly on components having complex geometries, so that a component to be coated cannot be activated uniformly on all areas of its surface.

Other methods known from the state of the art for the metallic coating of titanium components, for instance, with nickel, call for a heat treatment of the coated component in order to ensure proper adhesion of the metallic coating, as a result of which high costs are incurred. For an example of this, reference is hereby made to the state of the art in accordance with European patent specification EP 0 494 579 B1 and international patent application WO 90/03457 A1.

SUMMARY OF THE INVENTION

Before this background, an objective of an embodiment of the present invention is to create a novel method for the pre-treatment of titanium components for the subsequent application of a coating having a high adhesive strength.

This objective is achieved by means of a method for the pre-treatment of titanium components for the subsequent coating thereof as described in an embodiment of the present invention. According to an embodiment of the present invention, a method for the pre-treatment of titanium components for the subsequent coating thereof comprises at least the following steps: a) etching of the component in an acidic solution containing fluoride and nitric acid ($HNO_3$); b) activation pickling of the etched component in a solution containing at least sodium nitrate ($NaNO_3$) and tetrafluoroboric acid ($HBF_4$); c) activation of the activation-pickled component in a bath containing acid or in an acidic bath containing nickel.

DETAILED DESCRIPTION

Via a method for the pre-treatment of titanium components as described in an embodiment of the present invention, a metallic coating having a high adhesive strength can be achieved for these titanium components. A method according to an embodiment of the present invention works with solutions for etching, activation pickling and activation that are free of hexavalent chromium. This is advantageous from a safety standpoint. Another advantage of the method according to an embodiment of the present invention is that this method consists exclusively of chemical process steps, so that consequently, even components having complex geometries or surfaces with complex shapes can be uniformly pre-treated and coated.

Another advantage of the method according to an embodiment of the present invention is that the titanium components can be subsequently coated, for example, with nickel, without the need for a subsequent heat treatment of the coated components, which translates into cost advantages. The method according to an embodiment of the present invention is especially suitable for the pre-treatment of components made of titanium-based alloys containing aluminum.

According to an advantageous refinement of the invention, the etching procedure is carried out according to step a) in an aqueous solution containing 100 to 350 g/l of nitric acid ($HNO_3$) as well as 20 to 50 g/l of hydrofluoric acid (HF) or 30 to 70 g/l of ammonium hydrogen fluoride ($NH_4HF_2$) at room temperature for a duration of 1 to 6 minutes. The subsequent activation pickling is performed in a solution containing at least 10 to 60 g/l of sodium nitrate ($NaNO_3$) and 30 to 90 g/l of tetrafluoroboric acid ($HBF_4$) at a temperature between 30° C. and 50° C. [86° F. and 122° F.], especially at 50° C. [122° F.], for a duration of 10 to 30 minutes. A maximum process temperature of 50° C. [122° F.] makes it possible to apply a wax covering for a subsequent, selective coating. This considerably simplifies selective coating procedures.

The method according to an embodiment of the present invention relates to the pre-treatment of components made of titanium materials, especially components made of titanium-based alloys containing aluminum, for the subsequent metallic coating thereof, for instance, with nickel. The pre-treatment of the titanium components makes it possible to apply a metallic coating having a high adhesive strength onto the titanium components.

For purposes of pre-treating the titanium components, in a first step of the method according to an embodiment of the present invention, the titanium components are etched in an acidic solution. The acidic solution containing fluoride and employed for the etching procedure contains at least nitric acid ($HNO_3$). Preferably, the etching of the component takes place in an aqueous, acidic solution containing 100 to 350 g/l of nitric acid ($HNO_3$) as well as, preferably, 20 to 50 g/l of hydrofluoric acid (HF) or 30 to 70 g/l of ammonium hydrogen fluoride ($NH_4HF_2$). The etching in the aqueous solution consisting of nitric acid ($HNO_3$) and preferably hydrofluoric acid (HF) or ammonium hydrogen fluoride ($NH_4HF_2$) is carried out at room temperature for a duration of 1 to 6 minutes. During the etching in the acidic solution, oxides present on the surface of the titanium component are dissolved and the surface is prepared for the subsequent process steps.

Following the etching of the component, in a second step of the method according to an embodiment of the present invention, the etched component is then activation-pickled. The activation pickling takes place in an acidic solution, whereby the surface of the titanium component is roughened up during the activation pickling. The solution used for the activation pickling contains at least sodium nitrate ($NaNO_3$) and tetrafluoroboric acid ($HBF_4$). Preferably, the solution for the activation pickling contains at least 10 to 60 g/l of sodium nitrate ($NaNO_3$) and 30 to 90 g/l of tetrafluoroboric acid ($HBF_4$).

According to an advantageous refinement, the solution used for the activation pickling contains in addition to sodium nitrate ($NaNO_3$) and tetrafluoroboric acid ($HBF_4$), 25 to 50 g/l of sodium ($Na^+$) and 45 to 100 g/l of fluorine ($F^-$) as well as 10 to 40 g/l of $NO_3^-$.

As an alternative, the solution used for the activation pickling can be one that, aside from sodium nitrate ($NaNO_3$) and tetrafluoroboric acid ($HBF_4$), also contains sodium hydroxide (NaOH) and sodium tetrafluoroborate ($NaBF_4$), whereby the composition of such a solution then preferably contains 20 to 50 g/l of sodium nitrate ($NaNO_3$), 50 to 70 g/l of tetrafluoroboric acid ($HBF_4$), 15 to 35 g/l of sodium hydroxide (NaOH) and 5 to 50 g/l of sodium tetrafluoroborate ($NaBF_4$).

The pH value of the solutions used for the activation pickling lies between 1.5 and 2.5.

The activation pickling of the etched component using one of the above-mentioned solutions is preferably carried out at a temperature between 30° C. and 50° C. [86° F. and 122° F.], especially at 50° C. [122° F.], for a duration of between 10 and 30 minutes. During the activation pickling, the titanium in the titanium material of the component to be pre-treated becomes very active. Metal ions are dissociated by redox reactions and metal is removed from the surface. Aluminum ions migrate from the titanium alloy into the solution used for the pickling, and these aluminum ions, together with the sodium ions and the fluorine ions present in the solution, form a crystal layer on the surface of the titanium component. The crystal layer here consists of sodium aluminum fluoride ($Na_3AlF_6$), which is also referred to as cryolite. The surface of the component develops a considerable roughness, and this roughness is important for the subsequent coating of the component.

In order to provide sufficient roughness on the surface of the component, the attack on the metal during the activation pickling has to be strong enough and it has to be inhibited within a few minutes by means of sufficient crystallization, whereby this is achieved by means of the solutions for the activation pickling defined above. The formation of the crystal layer during the activation pickling protects the surface of the titanium component against oxidation, so that the titanium remains active underneath the crystals. As a result, the titanium components can be kept active over the course of a relatively long period of time after the second step of the method according to the invention.

As already mentioned, the activation pickling takes place at a temperature between 30° C. and 50° C. [86° F. and 122° F.]. This means that, prior to the activation, sections of the surface of the component that are not to be subsequently coated can be covered, for example, with wax. Consequently, the method according to an embodiment of the present invention allows a selective metallic coating of selected surface areas which, owing to the use of wax, is more favorable than with other covering systems.

The crystallization that takes place during the activation pickling is also dependent on the roughness created on the surface of the component when the component was etched. If the etching creates an insufficient or an excessive roughness on the surface of the component, the crystals are formed irregularly during the subsequent activation pickling, so that the activation pickling does not transpire in an optimal manner. Therefore, the execution of the process steps of etching and of activation pickling are interdependent.

After the activation pickling of the component to be pre-treated, the activation-pickled component is activated in a third step of the method according to an embodiment of the present invention. In this process, the activation takes place immediately before the metallic coating of the component, whereby the crystal layer formed during the activation pickling is dissolved during the activation in order to expose the activated titanium surface of the component to be coated. This activation can be carried out in that the activation-pickled component is activated either in a bath containing acid or in an acidic bath containing nickel.

According to a first variant, the components made of a Ti64 alloy are activated in a bath containing sulfuric acid at a temperature between 20° C. and 50° C. [68° F. and 122° F.] for a duration of between 10 and 40 seconds. In the case of components made of the alloys Ti6241, Ti6246 and Ti834, the activation takes place in a bath containing nitric acid at a temperature between 20° C. and 50° C. [68° F. and 122° F.] for a duration of between 15 and 40 seconds.

According to a second alternative, the component made of a Ti64 alloy is activated in a bath containing nickel at a temperature between 40° C. and 60° C. [104° F. and 140° F.] for a duration of between 20 and 60 seconds, whereby the component is subsequently electroplated in this bath containing nickel. With this alternative, there is no need to change the bath after the activation and before the coating, thus preventing oxidation of the component during a bath change, as a result of which the adhesive strength of the metallic coating to the component is improved.

Example 1

In an exemplary embodiment of the invention, a component made of a titanium alloy and containing aluminum, namely, TiAl6V4, is etched in a first step in an aqueous solution, whereby the aqueous solution contains 350 g/l of a 65%-solution of nitric acid ($HNO_3$) and 67 g/l of ammonium hydrogen fluoride ($NH_4HF_2$). The etching is carried out at room temperature for a duration of 2 minutes under constant agitation of the aqueous solution.

Subsequently, the etched component is activation-pickled in a solution containing 40 g/l of sodium nitrate ($NaNO_3$), 60 g/l of tetrafluoroboric acid ($HBF_4$), 30 g/l of sodium tetrafluoroborate ($NaBF_4$) and 28 g/l of sodium hydroxide (NaOH) and having a pH value of about 1.7. The activation pickling is performed at a temperature of 50° C. [122° F.] for a duration of 20 minutes.

Following the activation pickling, the activation is carried out in a third step, namely, in a 40%-solution of sulfuric acid at a temperature of 20° C. [68° F.] for a duration of 20 seconds.

Following the activation, metallic coating of the component can be carried out, for which purpose the component is coated in a nickel-sulfamate bath at a working temperature of 50° C. [122° F.] until a layer thickness of approximately 800 μm is obtained, and whereby the current density during the electroplating is 2 A/dm$^2$. The metallic coating that forms during this process exhibits an outstanding adhesive strength. The adhesive strength of the coating is between 210 and 300 N/mm$^2$.

Example 2

In another exemplary embodiment, components made of the TiLa6V4 material are etched and activation-pickled in a manner identical to the first exemplary embodiment, with the subsequent activation taking place in an acidic nickel bath.

The nickel bath consists of 300 g/l of nickel sulfate ($NiSO_4$), 20 g/l of boric acid ($H_3BO_3$), 8 ml/l of nickel chloride ($NiCl_2$), 55 ml/l of amine sulfone and a wetting agent. The activation in such a nickel bath is carried out for a duration of 45 seconds at 50° C. [122° F.] and, after the 45 seconds have passed, a current at a density of 10 A/dm$^2$ is switched on for the electroplating. The coating in this bath is done for 15 minutes. Subsequently, the pre-coated titanium components are transferred into a nickel-sulfamate bath and further coated at a temperature of 50° C. [122° F.] and at a current density of 2 A/dm$^2$. Here, too, a metallic coating can be created that exhibits outstanding adhesive values.

What is claimed is:

1. A method for the pre-treatment of titanium components for the subsequent coating thereof, comprising:

a) etching a titanium component in an acidic solution containing fluoride and nitric acid (HNO3);

b) activation pickling the etched titanium component in a solution including 20 to 50 g/l of sodium nitrate ($NaNO_3$), 50 to 70 g/l of tetrafluoroboric acid ($HBF_4$), and either: (a) 15 to 35 g/l of sodium hydroxide (NaOH) and 5 to 50 g/l of sodium tetrafluoroborate ($NaBF_4$); or (b) 25 to 50 g/l of sodium ($Na^+$) and 45 to 100 g/l of fluorine ($F^-$);

c) activating the activation-pickled titanium component in a bath containing acid or in an acidic bath containing nickel.

2. The method as recited in claim 1, wherein the titanium components are components made of a titanium-based alloy containing aluminum.

3. The method as recited in claim 1, wherein the step of etching a titanium component is performed in a solution that includes nitric acid ($HNO_3$) and hydrofluoric acid (HF) or ammonium hydrogen fluoride ($NH_4HF_2$).

4. The method as recited in claim 3, wherein the step of etching a titanium component is performed in an aqueous solution containing 100 to 350 g/l of nitric acid ($HNO_3$) as well as 20 to 50 g/l of hydrofluoric acid (HF) or 30 to 70 g/l of ammonium hydrogen fluoride ($NH_4HF_2$).

5. The method as recited in claim 1, wherein the solution used for the step of activation pickling the etched titanium component has a pH value between 1.5 and 2.5.

6. The method as recited in claim 1, wherein the step of activation pickling the etched titanium component is performed at a temperature between 30° C. and 50° C. [86° F. and 122° F.] for a duration of between 10 and 30 minutes.

7. The method as recited in claim 1, wherein the step of activating the activation-pickled titanium component is performed in a bath containing sulfuric acid at a temperature between 20° C. and 50° C., or between 68° F. and 122° F., for a duration of between 10 and 40 seconds.

8. The method as recited in claim 1, wherein the step of activating the activation-pickled titanium component is performed in a bath containing nickel at a temperature between 40° C. and 60° C., or between 104° F. and 140° F., for a duration of between 20 and 60 seconds, the titanium component in the bath containing nickel subsequently being electroplated with nickel.

9. The method as recited in claim 8, wherein the bath containing nickel includes nickel sulfate ($NiSO_4$), boric acid ($H_3BO_3$), nickel chloride ($NiCl_2$) and amine sulfone.

* * * * *